US010517368B2

(12) United States Patent
Lyttle et al.

(10) Patent No.: US 10,517,368 B2
(45) Date of Patent: Dec. 31, 2019

(54) NAIL CLIPPING AND COLLECTING DEVICE

(71) Applicant: Clean Clip, Minnetrista, MN (US)

(72) Inventors: Andrea Lyttle, Minnestrista, MN (US); Caleb Summers, Richfield, MN (US)

(73) Assignee: CLEAN CLIP, Minnetrista, MN (US)

( * ) Notice: Subject to any disclaimer, the term of this patent is extended or adjusted under 35 U.S.C. 154(b) by 26 days.

(21) Appl. No.: 16/034,729

(22) Filed: Jul. 13, 2018

(65) Prior Publication Data

US 2019/0029390 A1 Jan. 31, 2019

Related U.S. Application Data

(60) Provisional application No. 62/537,075, filed on Jul. 26, 2017.

(51) Int. Cl.
*A45D 29/02* (2006.01)

(52) U.S. Cl.
CPC ..... *A45D 29/023* (2013.01); *A45D 2029/026* (2013.01)

(58) Field of Classification Search
CPC ..... A45D 29/023; A45D 2029/026
USPC ..... 30/28; 132/73.5, 75, 75.5
See application file for complete search history.

(56) References Cited

U.S. PATENT DOCUMENTS

| | | | | |
|---|---|---|---|---|
| 796,389 A | | 8/1905 | Wright et al. | |
| 2,753,626 A | * | 7/1956 | Bowers | A45D 29/02 30/28 |
| 3,299,505 A | * | 1/1967 | Pionek | B26B 19/00 30/29 |
| 3,903,596 A | * | 9/1975 | Crosby | A45D 29/023 30/29 |
| 3,943,948 A | * | 3/1976 | Sartore | A45D 29/02 132/73 |
| 4,341,015 A | | 7/1982 | Young | |
| 4,602,430 A | * | 7/1986 | Allen, Jr. | A45D 29/023 30/28 |
| 4,956,915 A | | 9/1990 | Anderson | |
| 5,046,606 A | | 9/1991 | Morelli | |

(Continued)

FOREIGN PATENT DOCUMENTS

| | | | |
|---|---|---|---|
| CH | 686111 | A5 | 1/1996 |
| DE | 29611699 | U1 | 9/1996 |

(Continued)

*Primary Examiner* — Hwei-Siu C Payer
(74) *Attorney, Agent, or Firm* — Fredrikson & Byron, P.A.

(57) ABSTRACT

A nail clipping and collecting device includes a housing and a clipper. The housing defines an interior volume and includes first and second actuation mechanisms. The clipper is enclosed by the housing. The clipper includes a first support having an end with a first cutting edge and a second support movably connected to the first support and having an end with a second cutting edge. The clipper includes a first lever arm having a first portion coupled to the first support and a second portion having a first interfacing surface interfacing with the first actuation mechanism and a second lever arm having a first portion coupled to the second support and a second portion having a second interfacing surface interfacing with the second actuation mechanism. As the first and second actuation mechanisms are actuated, the clipper is brought from a first disengaged position to a second engaged position.

20 Claims, 7 Drawing Sheets

(56) References Cited

U.S. PATENT DOCUMENTS

| | | | | |
|---|---|---|---|---|
| 5,150,521 | A * | 9/1992 | Han | A45D 29/023 30/28 |
| D345,628 | S | 3/1994 | Pacio | |
| 5,423,124 | A * | 6/1995 | Marrocco | A45D 29/023 29/525 |
| 5,459,926 | A | 10/1995 | Perea | |
| 5,546,658 | A | 8/1996 | MacLeod et al. | |
| 5,632,288 | A | 5/1997 | Webb | |
| 5,881,735 | A | 3/1999 | Kutnik | |
| 6,088,919 | A | 7/2000 | Gilman | |
| 6,173,497 | B1 | 1/2001 | Domenge | |
| D516,249 | S | 2/2006 | Merheje | |
| 7,062,855 | B2 | 6/2006 | Merheje | |
| 7,222,427 | B1 | 5/2007 | Kaidi et al. | |
| D591,908 | S | 5/2009 | Pacio | |
| D629,161 | S | 12/2010 | Farris | |
| D639,509 | S | 6/2011 | Farris | |
| D639,510 | S | 6/2011 | Farris | |
| 8,496,013 | B2 | 7/2013 | McCourtney | |
| 8,640,319 | B2 | 2/2014 | McMullen, Jr. | |
| D735,411 | S | 7/2015 | Champe et al. | |
| 9,204,703 | B2 | 12/2015 | Farris | |
| 2011/0061239 | A1* | 3/2011 | Pacio | A45D 29/02 30/28 |
| 2011/0154667 | A1* | 6/2011 | Farris | A45D 29/02 30/28 |
| 2012/0204891 | A1* | 8/2012 | McCourtney | A45D 29/023 132/73.5 |
| 2015/0013165 | A1 | 1/2015 | Chi et al. | |
| 2016/0286931 | A1* | 10/2016 | LaTorre | A45D 29/023 |
| 2019/0029390 | A1* | 1/2019 | Lyttle | A45D 29/023 |

FOREIGN PATENT DOCUMENTS

| | | | |
|---|---|---|---|
| DE | 19751097 | A1 | 5/1998 |
| DE | 29922679 | U1 | 3/2000 |
| DE | 202005010136 | U1 | 9/2005 |
| EP | 2340738 | A1 | 7/2011 |
| FR | 2603467 | A1 | 3/1988 |
| FR | 2890294 | A1 | 3/2007 |
| GB | 2417199 | A | 2/2006 |
| JP | 141083 | S | 9/1933 |
| WO | 9808414 | A1 | 3/1998 |
| WO | WO 2017/194178 | A1 * | 11/2017 |

* cited by examiner

NAIL CLIPPING AND COLLECTING DEVICE

RELATED APPLICATION

This application claims the benefit of U.S. Provisional Application No. 62/537,075, filed Jul. 26, 2017, the contents of which are hereby incorporated by reference.

TECHNICAL FIELD

This disclosure generally relates to nail clipping and collecting devices as well as methods associated with such devices.

BACKGROUND

Clipping fingernails and toenails is a recurrent task that usually involves use of a nail clipper. In use, an individual nail is generally placed relative to the nail clipper and the nail clipper acts to sever an end portion of the nail, and thereby shorten the length of the remaining nail. This is repeated for all nails needing to be clipped, and often times can include repeating this process multiple times with respect to a single nail.

However, clipping fingernails and toenails may be messy and time consuming. This can be due to scattering of the individual, severed nail portions during clipping. Upon being cut, nail portions tend to discharge from the nail clipper in an unpredictable direction. Often times nail portions may discharge from the nail clipper at relatively high speeds such that they wind up at locations relatively distant from where the clipping took place. Consequently, finding and retrieving the cut nail portions can be burdensome. This can be particularly true when a number of nail portions are cut, such as when all fingernails and/or toenails are cut (sometimes cutting multiple nail portions from each of multiple nails).

SUMMARY

In general, various exemplary embodiments relating to nail clipping and collecting devices, and methods associated with such devices, are disclosed herein. Certain embodiments can be useful, for instance, in clipping nails (fingernails and/or toenails) while retaining cut nail portions in a convenient location. This can reduce the mess associated with nail clipping and thereby reduce the time and effort needed to perform what is generally a recurrent life task. Embodiments of the nail clipping and collecting device can be designed to allow for cut nail portions retained thereat to be easily cleaned out, when desired, and may allow for a clipper of the nail clipping and collecting device to be easily removed for periodic cleaning.

One exemplary embodiment includes a nail clipping and collecting device. This embodiment of the nail clipping and collecting device includes a housing and a clipper. The housing defines an interior volume and the housing includes a first actuation mechanism and a second actuation mechanism each movable relative to the housing. The clipper is positioned within the interior volume and enclosed by the housing. The clipper includes a first support having a first end with a first cutting edge and a second support having a first end with a second cutting edge. The second support is movably connected to the first support. The clipper also includes a first lever arm having a first portion coupled to the first support and a second portion having a first interfacing surface that interfaces with the first actuation mechanism and a second lever arm having a first portion coupled to the second support and a second portion having a second interfacing surface that interfaces with the second actuation mechanism. This embodiment of the nail clipping and collecting device is configured such that as the first actuation mechanism and the second actuation mechanism are actuated the clipper is brought from a first disengaged position to a second engaged position. For instance, when the clipper is in the first disengaged position the first cutting edge and the second cutting edge are spaced apart and when the clipper is in the second engaged position the first cutting edge and the second cutting edge are brought closer together than when in the first disengaged position.

In a further embodiment of this nail clipping and collecting device, the housing includes a flexible shroud that has a first panel, a second panel, and a slot defined between the first panel and the second panel. The first panel and the second panel can comprise a material that has a lower flexural modulus than that of a material forming a body of the surrounding housing. In addition, in some cases, the clipper can define a central longitudinal axis and the second support can be pivotally connected to the first support at the central longitudinal axis. This central longitudinal axis of the clipper can be aligned with the slot of the flexible shroud.

Moreover, in certain such embodiments, the nail clipping and collecting device is configured such that as the clipper is brought from the first disengaged position to the second engaged position a second end of the first support that is opposite the first end of the first support moves off of the central longitudinal axis of the clipper and a second end of the second support that is opposite the first end of the second support moves off of the central longitudinal axis of the clipper.

Another exemplary embodiment includes a method of operating a nail clipping and collecting device. This method embodiment includes moving a cover relative to a housing so as to expose a slot on the housing leading to an interior volume of the housing. The method can further include inserting a nail within the slot and into the interior volume of the housing. In addition, the method can include actuating two actuation mechanisms on the housing to thereby bring two cutting edges of a clipper enclosed within the interior volume of the housing closer together. Such step may in some cases include contacting two interfacing surfaces (e.g., platforms) of the clipper with the respective actuation mechanisms.

The details of one or more examples are set forth in the accompanying drawings and the description below. Other features, objects, and advantages will be apparent from the description and drawings.

BRIEF DESCRIPTION OF THE DRAWINGS

The following drawings are illustrative of particular embodiments of the present invention and therefore do not limit the scope of the invention. The drawings are intended for use in conjunction with the explanations in the following description. Embodiments of the invention will hereinafter be described in conjunction with the appended drawings, wherein like numerals denote like elements.

FIG. 1A shows an example of a first operational configuration of the nail clipping and collecting device, while FIG. 1B shows an example of a second operational configuration of the nail clipping and collecting device.

FIG. 3A shows an example of a first operational configuration of the clipper, while FIG. 3B shows an example of a second operational configuration of the clipper.

FIG. 5A shows a longitudinal cross-sectional view of the nail clipping and collecting device of FIG. 1A in the first operational configuration, while FIG. 5B shows a longitudinal cross-sectional view of the nail clipping and collecting device of FIG. 1B in the second operational configuration.

DETAILED DESCRIPTION

The following detailed description is exemplary in nature and is not intended to limit the scope, applicability, or configuration of the invention in any way. Rather, the following description provides some practical illustrations for implementing exemplary embodiments of the present invention. Examples of constructions, materials, and/or dimensions are provided for selected elements. Those skilled in the art will recognize that many of the noted examples have a variety of suitable alternatives.

Figure 1A:
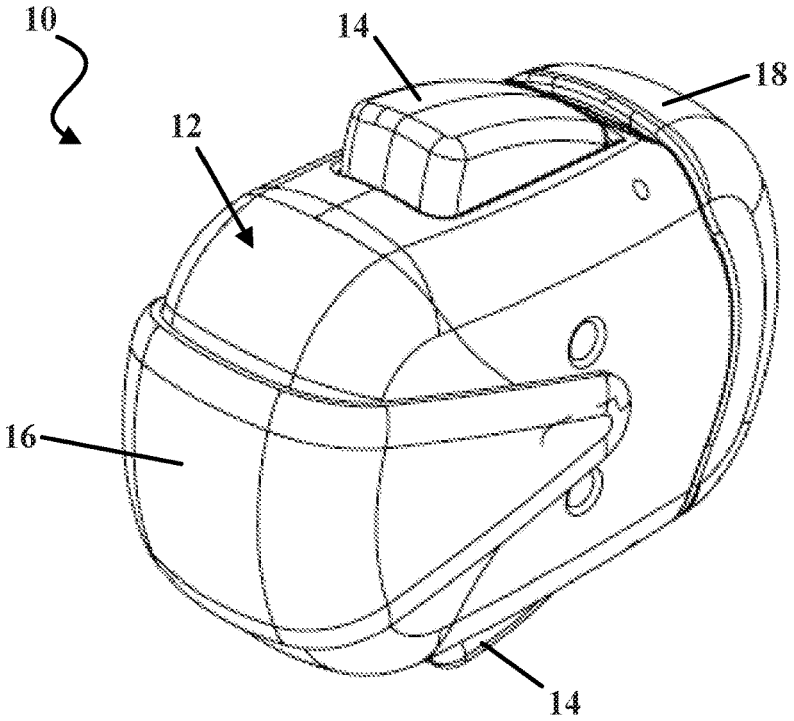
FIGS. 1A and 1B are perspective views of an exemplary embodiment of a nail clipping and collecting device.
Figure 1B:
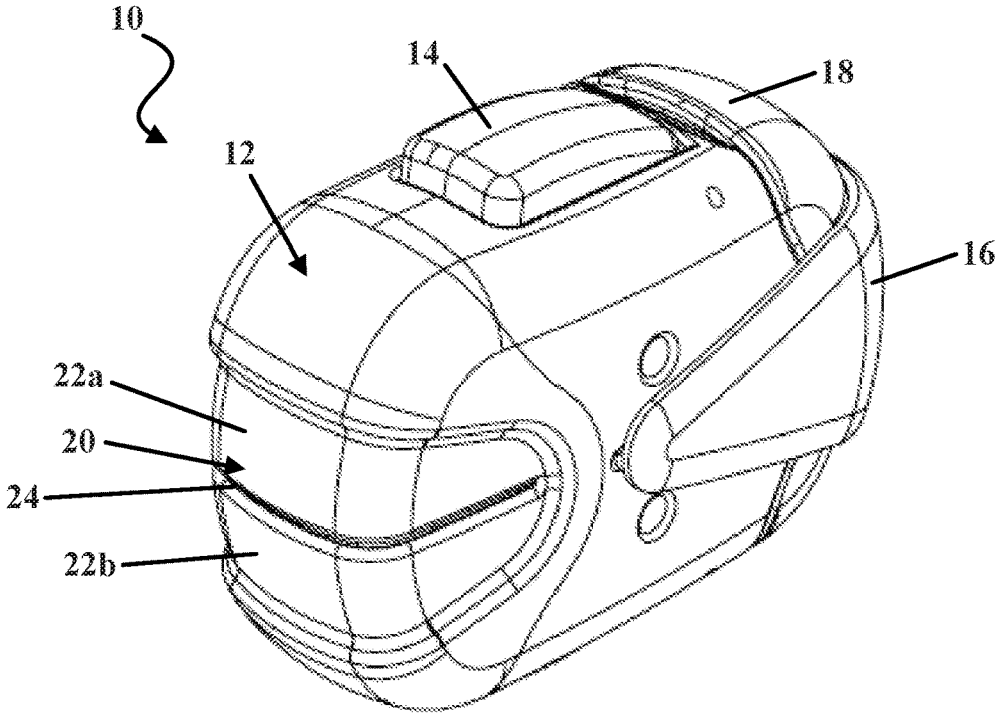

FIGS. 1A and 1B illustrate perspective views of an exemplary embodiment of a nail clipping and collecting device 10. The nail clipping and collecting device 10 can include a number of features useful for clipping nails (fingernails and/or toenails) while catching and retaining cut nail portions in a convenient location, for instance at the nail clipping and collecting device 10.

Figure 5A:
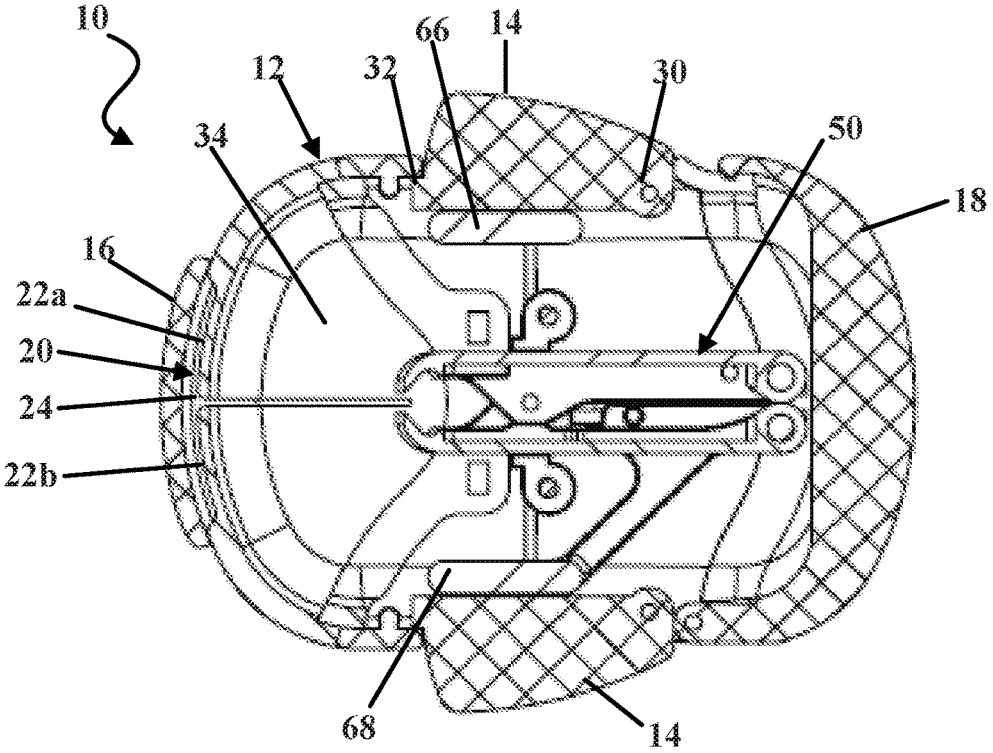
FIGS. 5A and 5B are cross-sectional views of the exemplary embodiment of the nail clipping and collecting device.
Figure 5B:
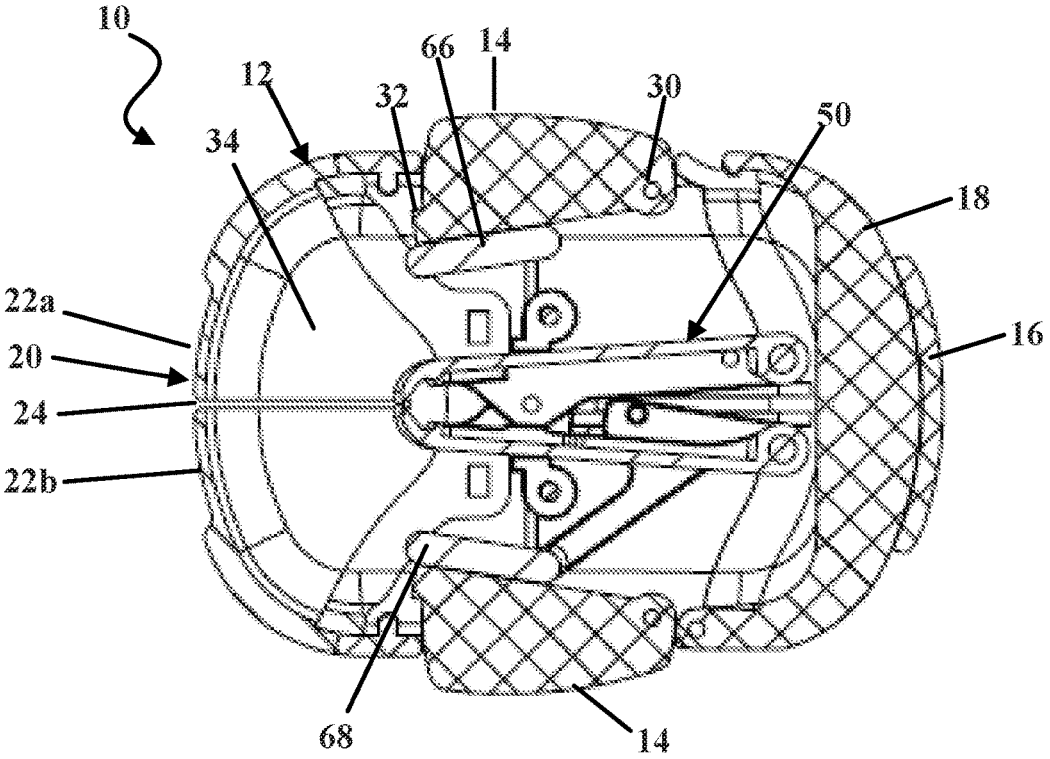

The nail clipping and collecting device 10 includes a housing 12 and a clipper (shown, e.g., in FIGS. 5A and 5B). The housing 12 can define an interior volume within which the clipper can be positioned. In use, a user can insert a nail within the interior volume of the housing 12 and actuate the clipper by interacting with the housing 12. The housing 12 may retain and collect cut nail portions thereat. In one embodiment, the housing 12 is made up of, at least in part, one or more transparent materials so that the clipper and inserted nail can be seen by a user within the housing 12.

As shown in FIGS. 1A and 1B, the housing 12 can include a number of features, including actuation mechanisms 14, cover 16, door 18, and flexible shroud 20. Actuation mechanisms 14 can be movably coupled to the housing 12 such that actuation mechanisms 14 move relative to the housing 12. In the illustrated embodiment, actuation mechanisms 14 are pivotally coupled to the housing 12 via a hinged connection thereat. In other embodiments, actuation mechanisms 14 can be movably coupled to the housing 12 in other manners (e.g., slidably coupled to the housing 12). In this example, two actuation mechanisms 14 are included. The two actuation mechanisms 14 are located at opposite ends of the housing 12 and aligned along a common axis extending through the housing 12. As shown, the actuation mechanisms 14 are in the form of movable (e.g., depressible) buttons, though in other embodiments actuation mechanisms 14 can take a variety of forms appropriate for a user interface feature (e.g., sliders, torqued flanges, etc.).

The cover 16 can be movably coupled to the housing 12 such that the cover 16 moves relative to the housing 12. In the illustrated embodiment, cover 16 is pivotally coupled to the housing 12 via a hinged connection thereat. In this example, the hinged connection can be configured to permit one hundred and eighty degree rotation of the cover 16 to and from opposite positions relative to the housing 12 and to hold the cover 16 in place at these opposite positions. For instance, in one position, at which the cover 16 can be held the cover 16 can overlay at least a portion of the flexible shroud 20 and at another position the cover 16 can be one hundred and eight degrees from the one position at which the cover 16 overlays the flexible shroud 20. As shown, the opposite positions at which the cover 16 can be held, when not being rotated, are offset from the locations of each of the actuation mechanisms 14 by ninety degrees about the housing 12. As such, when the cover 16 is at either position it does not interfere with the actuation mechanisms 14. In other embodiments, cover 16 can be movably coupled to the housing 12 in other manners (e.g., slidably coupled to the housing 12).

The door 18 can be movably coupled to the housing 12 such that the door 18 moves relative to the housing 12. In the illustrated embodiment, door 18 is pivotally coupled to the housing 12 via a hinged connection thereat. Moving the door 18 relative to the housing 12 can provide access to the interior volume of the housing 12. This may be useful in emptying out cut nail portions therein, cleaning the interior volume of the housing 12, and/or accessing the clipper within the interior volume (e.g., to remove it, such as for cleaning). In other embodiments, door 18 can be movably coupled to the housing 12 in other manners (e.g., slidably coupled to the housing 12). As shown here, the door 18 is located at a region of the housing 12 that is offset by ninety degrees about the housing 12 from each of the actuation mechanisms 14.

The flexible shroud 20 can form a region of the housing 12. As shown here, the flexible shroud 20 is located at a region of the housing 12 that is offset by ninety degrees about the housing 12 from each of the actuation mechanisms 14 and is opposite the door 18. In this embodiment, the flexible shroud 20 includes first panel 22*a*, second panel 22*b*, and slot 24 defined between the first and second panels 22*a*, 22*b*. The first and second panels 22*a*, 22*b* can each be made of one or more flexible materials. For instance, the first and second panels 22*a*, 22*b* can be made of material that has a lower flexural modulus than that of the material forming the surround housing body. The first and second panels 22*a*, 22*b* can flex a sufficient degree to allow the slot 24 to selectively enlarge while also generally resting on a user's finger/toe that is inserted at the slot 24.

FIG. 1A shows the nail clipping and collecting device 10 in a first operational configuration. The first operational configuration can be a non-clipping configuration, such as when the device 10 is not being used. As shown here, the cover 16 is positioned over the flexible shroud 20. This can be helpful in preventing inadvertent access to the slot 24. As also shown here, the actuation mechanisms 14 are in a first disengaged position. Where the actuation mechanisms 14 are in the form of depressible buttons, as in this example, this first operational configuration can include the depressible buttons projecting outward from the housing 12 to their greatest extent.

FIG. 1B shows the nail clipping and collecting device 10 in a second operational configuration. The second operational configuration can be a clipping configuration, such as when the device 10 is in use. As shown here, the cover 16 has been moved relative to the housing 12, away from the flexible shroud 20, such that the slot 24 is accessible. A user can insert a nail into the interior volume of the housing 12 via the slot 24. Once the nail is positioned appropriately, a user can then actuate the actuation mechanisms 14 to thereby act on the clipper within the interior volume of the housing and cut a portion of the nail. As also shown here, the actuation mechanisms 14 are in a second engaged position. Here, the actuation mechanisms 14 have been moved (e.g., rotated) relative to the housing 12. Where the actuation mechanisms 14 are in the form of depressible buttons as in this example, this second operational configuration can include the depressible buttons projecting out less from the housing 12 compared to that in the first operational configuration of FIG. 1A.

Figure 2:
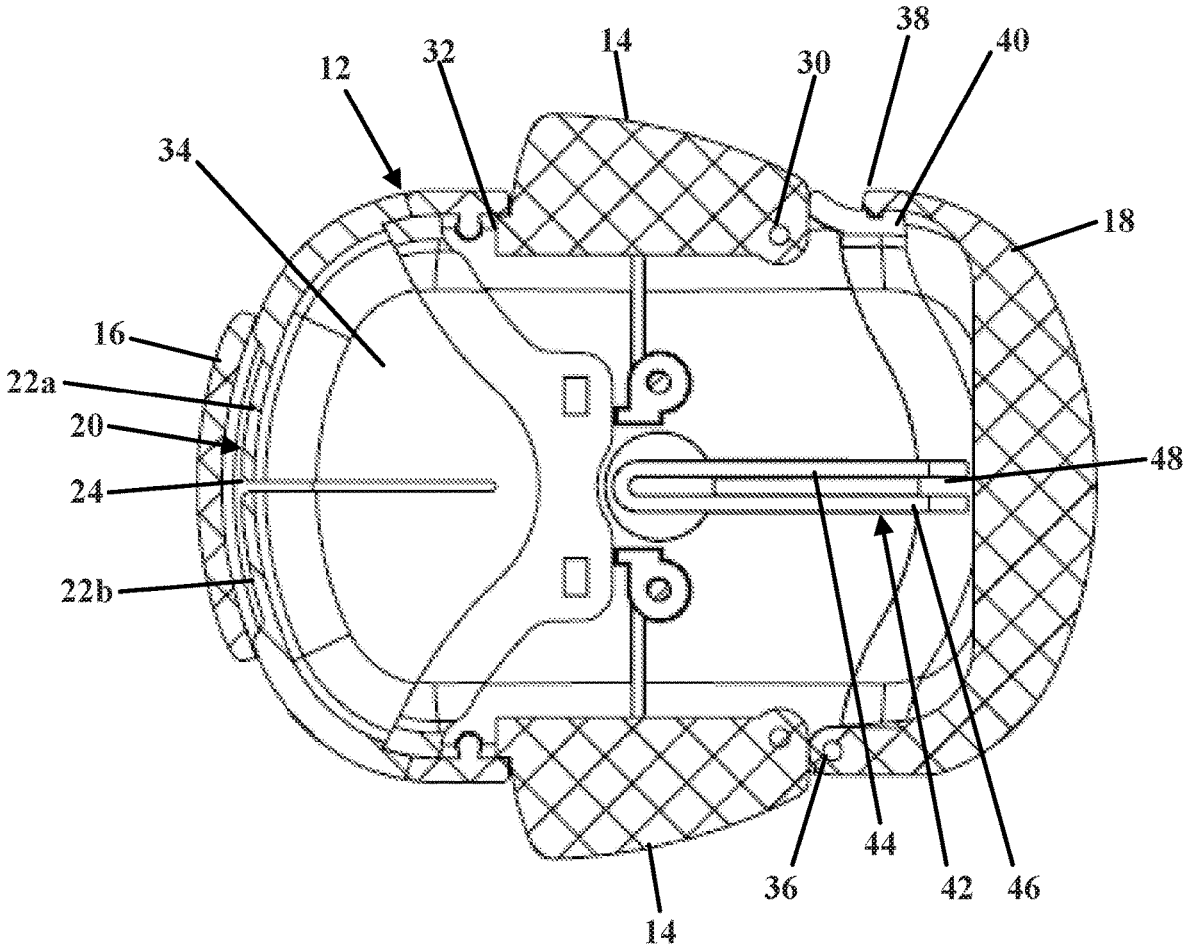
FIG. 2 is a longitudinal cross-sectional view of a housing, in isolation, of the nail clipping and collecting device of FIG. 1A.

FIG. 2 illustrates a longitudinal cross-sectional view of the housing 12, in isolation. Here, the housing 12 is shown with features in the first operational configuration as described above in connection with FIG. 1A. Each of the actuation mechanisms 14 is illustrated to include the hinged connection 30 and a retention flange 32. The retention flange 32 can define a receiving surface for contacting the housing 12. In some embodiments, the actuation mechanisms 14 can be biased to the first disengaged position shown here, such as by the clipper (not shown here) within the interior volume 34 of the housing 12. When biased to the first disengaged position, the retention flange 32 can contact the housing 12 at the receiving surface to counteract the bias and hold the actuation mechanisms 14 at the first disengaged position. When the actuation mechanisms 14 are moved to the second engaged position, and thus rotated about the hinged connection 30, the retention flange 32 is moved away from the housing 12.

FIG. 2 further illustrates the door 18 in a closed position. The door 18 includes the hinged connection 36 and an engagement feature 38 that corresponds to a holding surface 40 on the outer surface of the housing 12. In this example, to hold the door 18 in a closed position, the engagement feature 38 on the door 18 is retained at the holding surface 40 of the housing 12. To open the door 18, the engagement feature 38 can be disengaged from the holding surface 40 to allow the door 18 to rotate about the hinged connection 36. When the door 18 is in the open position, the interior volume 34 of the housing 12 can be accessed.

Another feature of the housing 12 shown in FIG. 2 is a retention track 42. The retention track 42 can be positioned on an interior surface of the housing 12 and within the interior volume 34 of the housing 12. Although not shown here given the cross-sectional nature of FIG. 2, a second retention track may also be positioned on an interior surface of the housing 12 and within the interior volume 34 of the housing 12 at a location generally opposite the illustrated retention track 42. In the example shown, the retention track 42 can include a first wall 44 and a second wall 46 spaced a distance from the first wall 44. The first and second walls 44, 46 can be connected at an end thereof closest to the slot 24, such that this end can be referred to as a closed track end. As seen in the illustrated embodiment, the closed track end can be aligned on a plane passing through the actuation mechanisms 14. The first and second walls 44, 46 can define a track opening 48 therebetween at an end thereof closest to the door 18. The retention track 42 (and, in some cases, the second retention track not illustrated) can receive the clipper at the track opening 48 and be configured to removably retain the clipper within the interior volume 34 of the housing 12. In one example, the clipper may have a corresponding projection that is received within the retention track 42 at the track opening 48 and slid along the retention track 42 so as to be at, or near, the closed track end (e.g., and at least partially aligned with the actuation mechanisms 14).

Figure 3A:
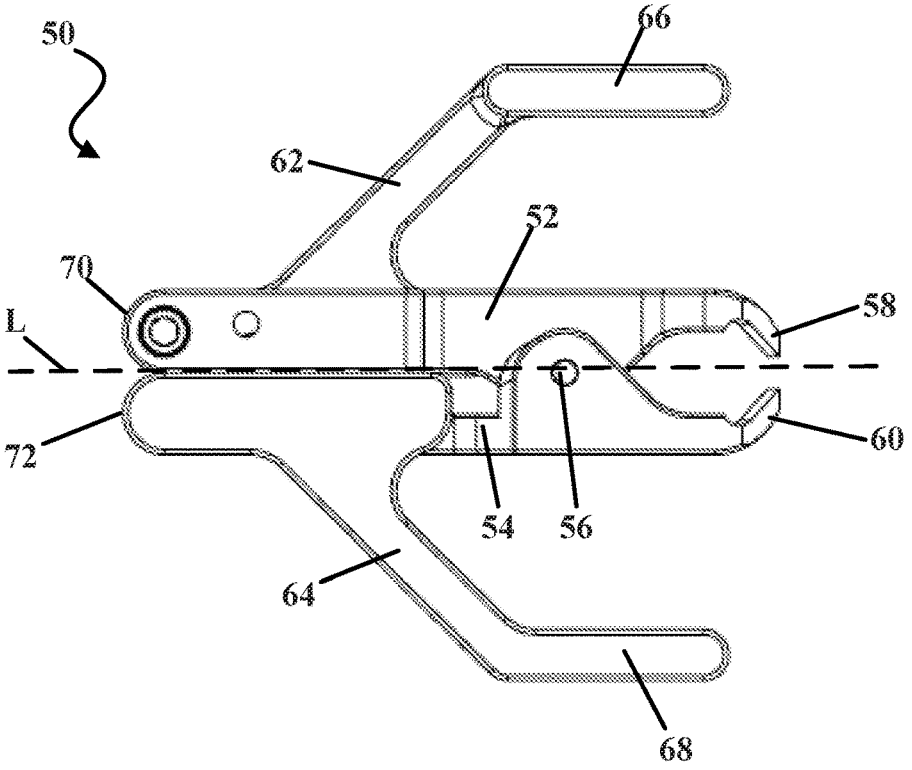
FIGS. 3A and 3B are elevational views of an exemplary embodiment of a clipper that may be used in the nail clipping and collecting device.
Figure 3B:
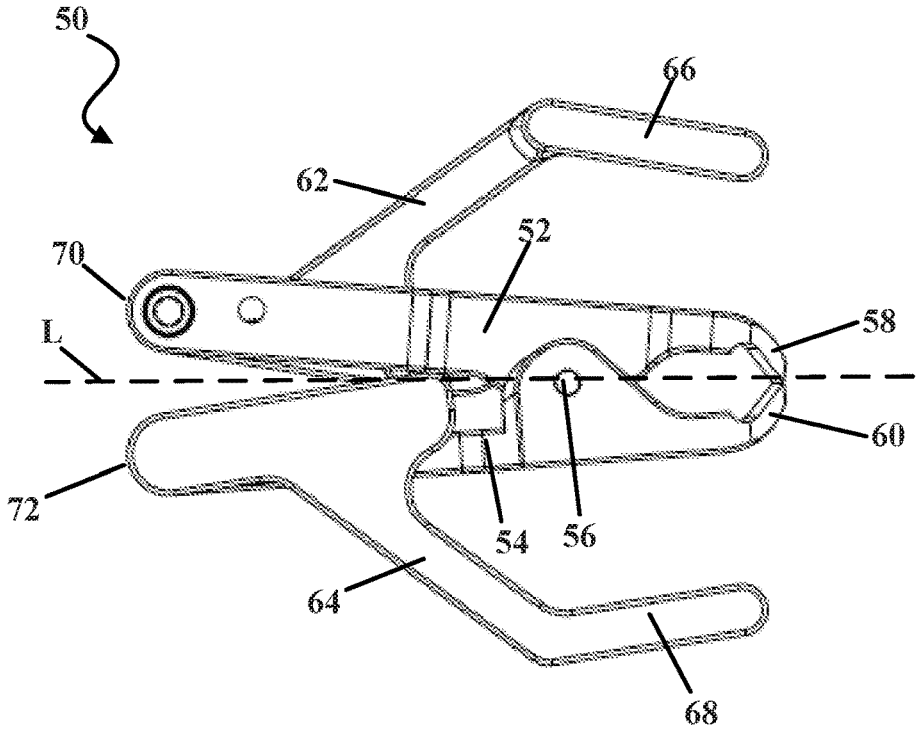

FIGS. 3A and 3B illustrate perspective views of an exemplary embodiment of the clipper 50. The exemplary clipper 50 may be used in the nail clipping and collecting device as described herein. FIG. 3A shows an example of a first disengaged position of the clipper 50 (e.g., when the nail clipping and collecting device is in the first operational configuration). FIG. 3B shows an example of a second engaged position of the clipper 50 (e.g., when the nail clipping and collecting device is in the second operational configuration).

The clipper 50 can include a first support 52 and a second support 54. In the illustrated example, the first support 52 and the second support 54 are movably connected together at hinged connection 56. The clipper 50 can further include opposing cutting edges, such that at an end of the first support 52 can be a first cutting edge 58 and at an end of the second support 54 can be a second cutting edge 60. A portion of a first lever arm 62 can be coupled to the first support 52 and a portion of a second lever arm 64 can be coupled to the second support arm 54. At one portion (e.g., an end) of the first lever arm 62, opposite an end coupled to the first support 52, can be a first interfacing surface (e.g., a platform) 66. At one portion (e.g., an end) of the second lever arm 64, opposite an end coupled to the second support 54, can be a second interfacing surface (e.g., a platform) 68. The interfacing surfaces, or as shown in the illustrated embodiment platforms, 66, 68 are generally disposed on, as measured along a central longitudinal axis L of the clipper 50, a cutting longitudinal half of the clipper 50, while the ends of the lever arms 62, 64 coupled to the respective supports 52, 54 are generally disposed on, as measured along the central longitudinal axis L, a non-cutting longitudinal half of the clipper 50. As shown in the illustrated example, the platforms 66, 68 form a planar extension from the respective lever arms 62, 64. As also shown in the illustrated example, the platforms 66, 68 extend out from the respective lever arms 62, 64 so as to be generally parallel to the respective supports 52, 54 (e.g., the platforms, or other interfacing surfaces, 66, 68 can extend along a longitudinal axis that is generally parallel to a longitudinal axis of the respective supports 52, 54 and parallel to the longitudinal axis L when the clipper is in the first disengaged position). But, in other examples, the interfacing surfaces 66, 68 can take a variety of non-planar extensions from the respective lever arms 62, 64 and may extend out therefrom at a variety of angles.

As noted, FIG. 3A shows the clipper 50 in an exemplary first disengaged position. The clipper may be biased to the disengaged position in some cases, by including a biasing member (e.g., an appropriate spring) at the clipper 50. Here, the first cutting edge 58 is spaced from the second cutting edge 60, such as to allow a portion of a nail to be fit in between. Also in this position, the first support 52 and the second support 54 are arranged in parallel to one another and the first interfacing surface 66 and the second interfacing surface 68 are arranged in parallel to one another. In addition, an end 70 of the first support 52 that is opposite the end having the first cutting edge 58 and an end 72 of the second support 54 that is opposite the end having the second cutting edge 60 are interfacing. As shown, the ends 70, 72 interface at the central longitudinal axis L.

In FIG. 3B, the clipper 50 is shown in an exemplary second engaged position. Here, the first cutting edge 58 and the second cutting edge 60 have been brought closer to one another, such as to cut the portion of the nail fit in between them. To bring the cutting edges 58, 60 to the engaged position, the interfacing surfaces (e.g., platforms) 66, 68 are actuated. As an example, to actuate the interfacing surfaces 66, 68 a force can be applied on each of the interfacing surfaces 66, 68 toward the central longitudinal axis L. In some cases, actuating the interfacing surfaces 66, 68 requires overcoming the bias of the clipper 50 to the disengaged position. In the illustrated embodiment, the interfacing surfaces 66, 68 are actuated by each moving toward the central longitudinal axis L. This actuation of the interfacing surfaces 66, 68 then pivots each of the respective supports 52, 54 about the hinged connection 56, bringing the cutting edges 58, 60 closer to one another and bringing the ends 70, 72 out of their interfacing position and away from the central longitudinal axis L. Thus, the clipper 50 can be configured to bring the first and second cutting edges 58, 60 into the engaged position upon the interfacing surfaces 66, 68 being brought toward the central longitudinal axis L at a cutting longitudinal half of the clipper 50, as measured along the central longitudinal axis L.

Figure 4:
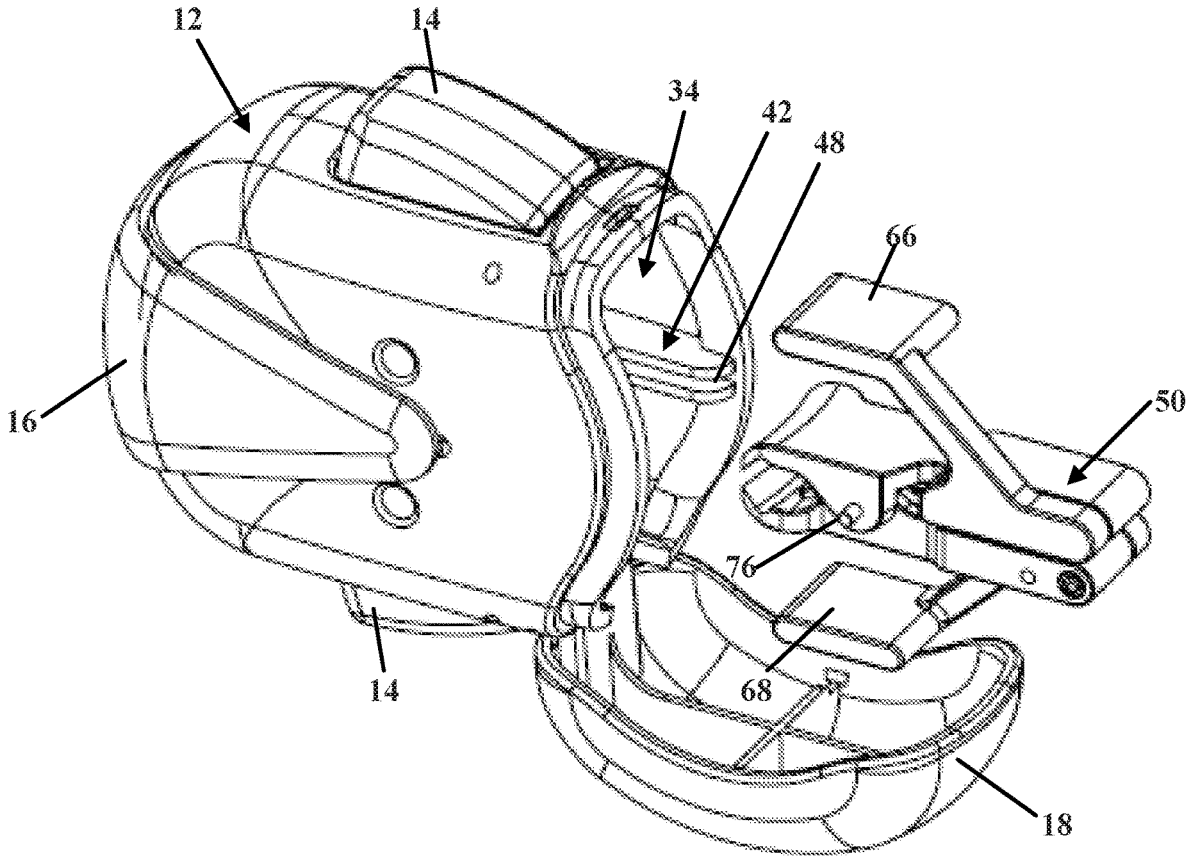
FIG. 4 is a perspective view illustrating the housing receiving the clipper.

FIG. 4 illustrates a perspective view of the housing 12 receiving the clipper 50. As shown here, the door 18 is in the opened position and the clipper 50 can be positioned within the housing 12 through the opening at the door 18. As described previously, the interior volume 34 of the housing 12 can include retention tracks 42 on opposite sides. When inserting the clipper 50 into the housing 12, a projection 76 of the clipper 50 can be received within the retention track 42 at the track opening 48 and slid along the retention track 42. The same can be true for a second projection on an opposite side of the clipper 50 and a second retention track. The clipper 50 may be slid along the retention track 42 until the interfacing surfaces 66, 68 are aligned with the actuation mechanisms 14 on the housing 12. While the clipper 50 is being positioned in the housing 12, the cover 16 can be positioned at the opposite side of the housing 12 (e.g., at the location of the flexible shroud). Once the clipper 50 is positioned within the housing 12, the door 18 can be closed and in this position help to secure the clipper 50 within the housing 12. Moreover, the ability to open the door 18 and remove the clipper from the housing 12 can facilitate cleaning of the clipper 50 and/or provide an accessible opening to the interior volume 34.

FIGS. 5A and 5B illustrate cross-sectional views of the exemplary embodiment of the nail clipping and collecting device 10. FIG. 5A shows a longitudinal cross-sectional view of the nail clipping and collecting device 10 of FIG. 1A in the first operational configuration. FIG. 5B shows a longitudinal cross-sectional view of the nail clipping and collecting device 10 of FIG. 1B in the second operational configuration.

As shown in FIGS. 5A and 5B, the clipper 50 is positioned in the interior volume 34 and enclosed by the housing 12 (e.g., the entirety of the clipper 50 is within the interior volume 34 and enclosed by the housing 12). In this example, the clipper 50 is positioned within the housing 12 such that the interfacing surfaces 66, 68 are aligned with the respective actuation mechanisms 14 on the housing 12. In one example, the interfacing surfaces 66, 68 may directly contact a surface of the respective, adjacent actuation mechanism 14. Also in this example, the clipper 50 is positioned within the housing 12 such that the cutting edges of the clipper 50 are aligned with the slot 24. In particular, a space defined between the two cutting edges of the clipper 50 can be aligned with an axis running through a central portion of the slot 24. In one example, the central longitudinal axis of the clipper 50 can pass through the slot 24.

The first operational configuration, shown in FIG. 5A, can be a non-clipping configuration, such as when the device 10 is not being used. As shown here, the actuation mechanisms 14 are in the first disengaged position. In some embodiments, the actuation mechanisms 14 can be biased to the first disengaged position. Here, the actuation mechanisms 14 are biased to the first disengaged positioned by the clipper 50 and, in particular, by the respective interfacing surfaces 66, 68. The clipper 50 may bias the actuation mechanisms 14 to the first disengaged position when the clipper 50 itself is in the first disengaged position, as shown in FIG. 5A. Thus, when the actuation mechanisms 14 are in the first disengaged position, the cutting edges of the clipper 50 can be in a non-clipping configuration (e.g., a space is present between the cutting edges). When biased to the first disengaged position, the retention flange 32 can contact the housing 12 at the receiving surface to counteract the bias and hold the actuation mechanisms 14 at the first disengaged position.

The second operational configuration can be a clipping configuration, such as when the device 10 is in use for clipping a nail. As shown here, the cover 16 has been moved (e.g., to a position of the door 18) in order to expose the flexible shroud 20 and its slot 24. This can allow a user to insert a nail within the slot 24 to a location of the cutting edges of the clipper 50. As also shown here, the actuation mechanisms 14 are in a second engaged position and the clipper 50 is also in the second engaged position. Here, the actuation mechanisms 14 have been actuated (e.g., after the nail is appropriately positioned), in turn bringing the clipper 50 from the first disengaged position to the second engaged position. In the illustrated embodiment, the actuation mechanisms 14 have been moved (e.g., rotated) relative to the housing 12 and in turn force the respective interfacing surfaces 66, 68 toward the central longitudinal axis of the clipper 50.

Thus, in the illustrated embodiment, a user can interact with the housing 12 in order to actuate the clipper 50. Namely, a user can actuate (e.g., push or otherwise apply force to) actuation mechanisms 14 on the housing 12 and the actuation members 14 in turn act on the interfacing surfaces 66, 68 of the clipper 50. Such a design may removably dispose an entirety of the clipper 50 within the housing 12, such that the housing 12 encloses the entirety of the clipper 50. This can help to retain and collect clipped nail portions with the housing 12.

Figure 6:
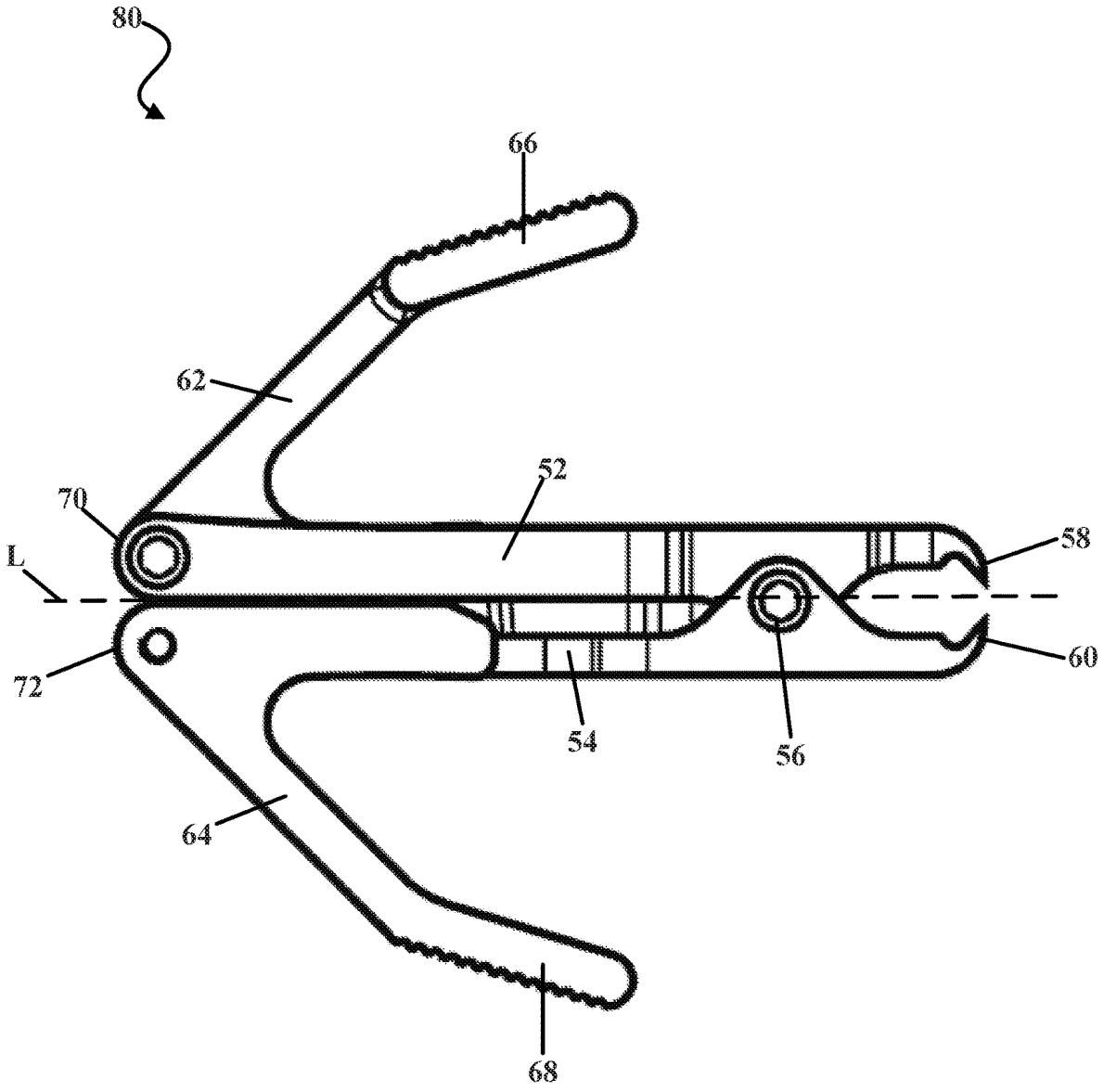
FIG. 6 is an elevational view of another exemplary embodiment of a clipper.

FIG. 6 illustrates an elevational view of another exemplary embodiment of a clipper 80. Except as otherwise noted, or shown with respect to FIG. 6, the clipper 80 can have some or all of the features described and shown with respect to the clipper 50 (e.g., in FIGS. 3A and 3B). As such, like numerals are used to indicate like elements. FIG. 6 shows the clipper 50 in the first disengaged position, as described with reference to FIG. 3A. The clipper 50 can be biased to this first disengaged position and can be brought to the second engaged position by actuating the interfacing surfaces 66, 68, as described with reference to FIG. 3B.

The clipper 80 includes angled interfacing surfaces 66, 68. In the embodiment illustrated here, the interfacing surfaces are shown in the form of platforms 66, 68 and can extend along a longitudinal axis that is generally non-parallel to a longitudinal axis of the respective supports 52, 54 and non-parallel to the central longitudinal axis L, of the clipper 80, when the clipper 80 is in the first disengaged position shown in FIG. 6. As such, the longitudinal axis along which the respective platform 66, 68 extends can intersect the longitudinal axis of the respective support 52, 54 and the central longitudinal axis L when the clipper 80 is in the first disengaged position. As illustrated in this exemplary embodiment, the platforms 66, 68 extend out at an angle away from the respective supports 52, 54 such that more space is created between each platform 66, 68 and the respective support 52, 54 as compared to that in the embodiment of the clipper 50. For example, as shown here, each platform 66, 68 may be at an angle greater than ninety degrees and less than one hundred and eighty degrees as measured from the respective lever arm 62, 64. This could include, for instance, each platform 66, 68 being at an angle between one hundred and one hundred and thirty five degrees, or one hundred and ten and one hundred and twenty five degrees, as measured from the respective lever arm 62, 64.

The configuration of the interfacing surfaces 66, 68 of the clipper 80 may provide a number of useful advantages. For instance, the angled interfacing surfaces 66, 68 of the clipper 80 can create more visibility for a user when clipping his or her nails. This can be particularly true when the clipper 80 is positioned within a housing of a nail clipping and collecting device (shown in FIG. 7) since the angled interfacing surfaces 66, 68 may be located so as to provide a substantially unobstructed viewing path for a user to see his or her nail at the cutting edges 58, 60. In addition, the angled interfacing surfaces 66, 68 may be able to provide increased leverage when actuated and thereby may provide an easier to use clipper.

Figure 7:
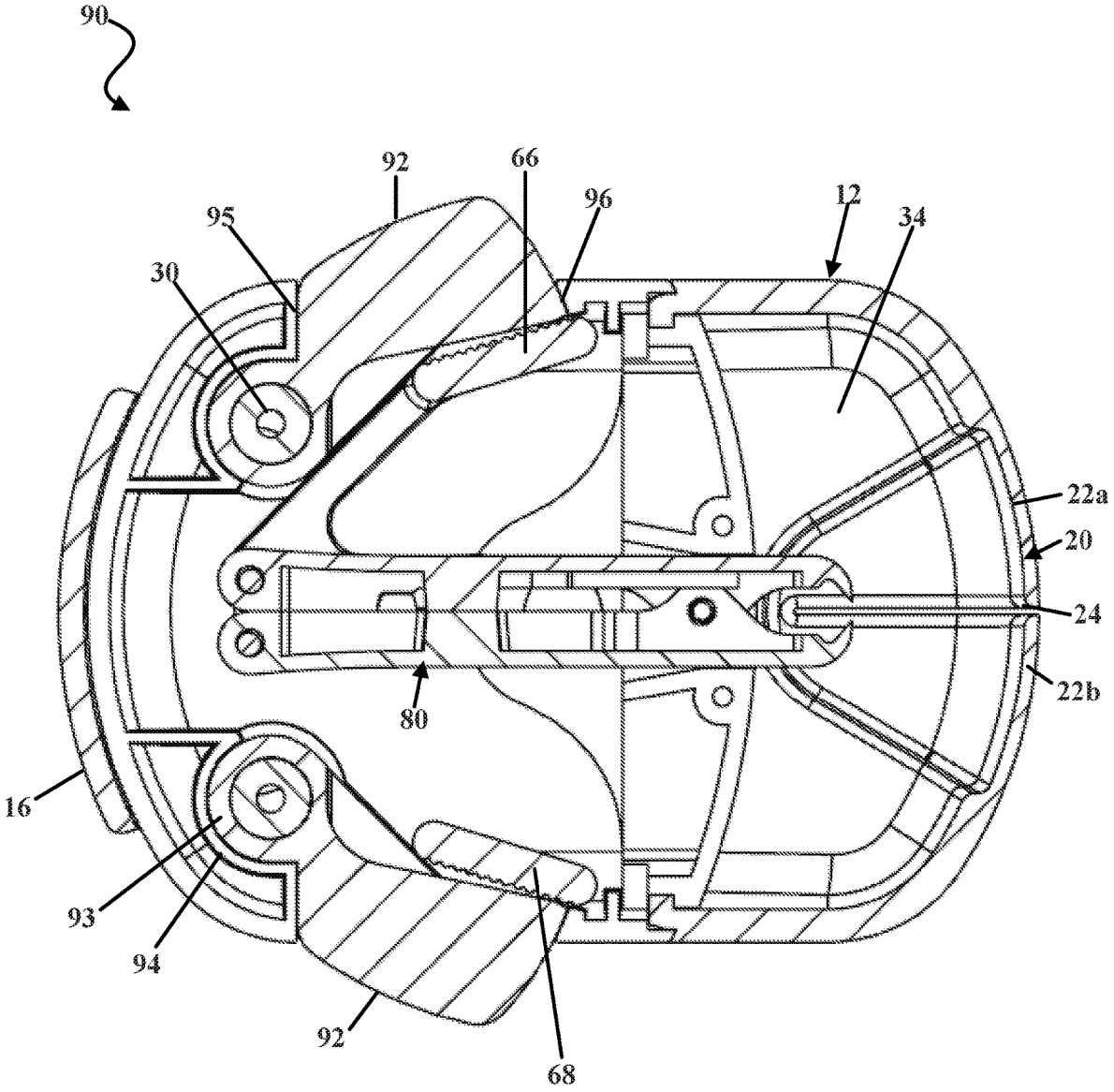
FIG. 7 is a cross-sectional view of another exemplary embodiment of a nail clipping and collecting device, including the clipper of FIG. 6.

FIG. 7 illustrates another exemplary embodiment of a nail clipping and collecting device 90. Except as otherwise noted, or shown with respect to FIG. 7, the nail clipping and collecting device 90 can have some or all of the features described and shown with respect to the nail clipping and collecting device 10 (e.g., in FIGS. 5A and 5B). As such, like numerals are used to indicate like elements. FIG. 7 shows the nail clipping and collecting device 90 in the first operational configuration, as described with reference to FIG. 5A. The nail clipping and collecting device 90 can be actuated to the second operational configuration, as described with reference to FIG. 5B, by actuating the actuation mechanisms 92. Actuation mechanisms 92 are shown in the illustrated embodiment in the form of depressible buttons but in other embodiments the actuation mechanisms 92 can take a number of suitable forms. Unlike the nail clipping and collecting device 10 described previously, the nail clipping and collecting device 90 shown here does not include a door. Rather, the clipper 80 may be positioned within, and removed from, the housing 12 at the flexible shroud 20.

As illustrated by FIG. 7, the nail clipping and collecting device 90 can be suitable for use with the clipper 80 having the angled interfacing surfaces 66, 68. For example, each of the actuation mechanisms 92 can be pivotally coupled to the housing 12 via a hinged connection 30 thereat. In this embodiment, each actuation mechanism 92 includes a pawl 93 at the hinged connection 30 that is located within the interior volume 34 of the housing 12 such that the pawl 93 may be the interior-most portion of the actuation mechanism 92 when the nail clipping and collecting device 90 is in the first operational configuration. As illustrated in FIG. 7, each pawl 93 can be seated within a curved recess 94 that is located within the interior volume 34 of the housing 12 and each actuation mechanism 92 can move relative to the curved recess 94 at the pawl 93. This configuration of the actuation mechanisms 92 can allow the actuation mechanisms 92 to angle out from the interior volume 34 and, as such, the actuation mechanisms 92 can be configured to interface with the respective angled interfacing surfaces 66, 68. As shown here, each interfacing surface 66, 68 can include a series of ridges along an outer surface that interfaces with the respective actuation mechanism 92 so as to increase friction therewith and provide an enhanced interface therebetween.

As also illustrated by FIG. 7, each actuation mechanism 92 includes a stop surface 95. The stop surface 95 can be configured to contact the housing 12 when the nail clipping and collecting device 90 in the first operational configuration. In addition, the housing 12 can include a retention surface 96 for interfacing with (e.g., contacting) the respective actuation mechanism 92 on a side of the actuation mechanism 92 opposite the stop surface 95. The retention surface 96 can include an increasing width, in a direction moving from the interior volume 34 to the outer surface of the housing 12, at the end interfacing with the respective actuation mechanism 92. Each of the stop surface 95, of the actuation mechanism 92, and the retention surface 96, of the housing 12, can serve to provide controlled actuation of the actuation mechanism 92 for moving the nail clipping and collecting device 90 between the first operational configuration and the second operational configuration.

The present disclose also encompasses a variety of methods associated with the nail clipping and collecting device disclosed herein. Such methods can relate to manufacturing, using/operating, and/or maintaining (e.g., cleaning) the nail clipping and collecting device. As would be appreciated in view of the present disclosure, such methods can include any number of steps relating to any one or more features disclosed herein.

For example, one exemplary method embodiment can include a method of operating a nail clipping and collecting device. This method embodiment can include the step of moving a cover relative to a housing of the nail clipping and collecting device so as to expose a slot on the housing leading to an interior volume of the housing. This method embodiment can further include the step of inserting a nail within the slot and into the interior volume of the housing. In addition, this method embodiment can include the step of actuating two actuation mechanisms on the housing to thereby bring two cutting edges of a clipper enclosed within the interior volume of the housing closer together. In a further embodiment, the method may also include a step of opening a door on the housing and removing the clipper from the interior volume of the housing through an opening at the door.

Various non-limiting exemplary embodiments have been described. It will be appreciated that suitable alternatives are possible without departing from the scope of the examples described herein.

What is claimed is:

1. A nail clipping and collecting device comprising:

a housing defining an interior volume, the housing including a first actuation mechanism and a second actuation mechanism each movable relative to the housing; and a clipper positioned within the interior volume and enclosed by the housing, the clipper comprising:

a first support having a first end with a first cutting edge;

a second support having a first end with a second cutting edge, the second support being movably connected to the first support;

a first lever arm having a first portion coupled to the first support and a second portion having a first interfacing surface, wherein the first interfacing surface interfaces with the first actuation mechanism; and a second lever arm having a first portion coupled to the second support and a second portion having a second interfacing surface, wherein the second interfacing surface interfaces with the second actuation mechanism, wherein the nail clipping and collecting device is configured such that as the first actuation mechanism and the second actuation mechanism are actuated the clipper is brought from a first disengaged position to a second engaged position.

2. The device of claim 1, wherein when the clipper is in the first disengaged position the first cutting edge and the second cutting edge are spaced apart and when the clipper is in the second engaged position the first cutting edge and the second cutting edge are brought closer together than when in the first disengaged position.

3. The device of claim 1, wherein the first actuation mechanism is at a first location on the housing and the second actuation mechanism is at a second location on the housing, the first location being opposite the second location on the housing.

4. The device of claim 3, wherein the housing further comprises a flexible shroud at a location that is offset by ninety degrees about the housing from each of the first actuation mechanism and the second actuation mechanism.

5. The device of claim 4, wherein the flexible shroud includes a first panel, a second panel, and a slot defined between the first panel and the second panel, and wherein the first panel and the second panel comprise a material that has a lower flexural modulus than that of a material forming a body of the housing surrounding the flexible shroud.

6. The device of claim 5, wherein the housing further comprises a cover configured to move relative to the housing between a first cover position and a second cover position, wherein the first cover position overlays the slot of the flexible shroud and the second cover position exposes the slot of the flexible shroud.

7. The device of claim 6, wherein each of the first cover position and the second cover position is offset by ninety degrees about the housing from each of the first actuation mechanism and the second actuation mechanism.

8. The device of claim 4, wherein the housing further comprises a door at a location that is offset by ninety degrees about the housing from each of the first actuation mechanism and the second actuation mechanism and by one hundred and eighty degrees about the housing from the flexible shroud.

9. The device of claim 1, wherein the housing further comprises a retention track within the interior volume of the housing, the retention track configured to receive the clipper and removably retain the clipper within the interior volume of the housing.

10. The device of claim 9, wherein the retention track comprises a first wall and a second wall spaced from the first wall, wherein the first wall and the second wall are connected at one end of the retention track to form a closed track end, and wherein the closed track end is located on a plane passing through the first actuation mechanism and the second actuation mechanism.

11. The device of claim 10, wherein the first wall and the second wall are spaced apart at another end of the retention track to form a track opening, and wherein the clipper includes a projection that is received at the track opening and held at the retention track.

12. The device of claim 1, wherein the clipper defines a central longitudinal axis and the second support is pivotally connected to the first support at the central longitudinal axis.

13. The device of claim 12, wherein the housing further comprises a flexible shroud that includes a first panel, a second panel, and a slot defined between the first panel and the second panel, and wherein the central longitudinal axis of the clipper is aligned with the slot.

14. The device of claim 12, wherein the nail clipping and collecting device is configured such that as the clipper is brought from the first disengaged position to the second engaged position a second end of the first support that is opposite the first end of the first support moves off of the central longitudinal axis and a second end of the second support that is opposite the first end of the second support moves off of the central longitudinal axis.

15. The device of claim 14, wherein the first interfacing surface extends from the second portion of the first lever arm in a direction relative to the central longitudinal axis toward the first cutting edge and the second interfacing surface extends from the second portion of the second lever arm in a direction relative to the central longitudinal axis toward the second cutting edge.

16. The device of claim 12, wherein the first interfacing surface and the second interfacing surface each extend parallel to the central longitudinal axis when the clipper is in the first disengaged position.

17. The device of claim 16, wherein each of the first actuation mechanism and the second actuation mechanism includes a retention flange contacting the housing when the clipper is in the first disengaged position.

18. The device of claim 12, wherein the first interfacing surface extends along an axis that intersects the central longitudinal axis and the second interfacing surface extends along an axis that intersects the central longitudinal axis when the clipper is in the first disengaged position.

19. The device of claim 18, wherein the housing includes a first curved recess within which a pawl of the first actuation mechanism is seated and a second curved recess within which a pawl of the second actuation mechanism is seated.

20. The device of claim 1, wherein the first interfacing surface includes a series of ridges that contact the first actuation mechanism and the second interfacing surface includes a series of ridges that contact the second actuation mechanism.

* * * * *